United States Patent [19]

Voigt

[11] Patent Number: 4,976,230

[45] Date of Patent: Dec. 11, 1990

[54] VALVE MECHANISM, PREFERABLY FOR AN INTERNAL COMBUSTION ENGINE, HAVING PRESSURE MEDIUM SUPPLY PASSAGE

[75] Inventor: Dieter Voigt, Wolfsburg, Fed. Rep. of Germany

[73] Assignee: Volkswagen AG, Wolfsburg, Fed. Rep. of Germany

[21] Appl. No.: 523,864

[22] Filed: May 15, 1990

[30] Foreign Application Priority Data

May 16, 1989 [DE] Fed. Rep. of Germany ..... 3915841

[51] Int. Cl.[5] ..... F01L 1/24; F01L 1/10

[52] U.S. Cl. ..... 123/90.49; 123/90.55

[58] Field of Search ..... 123/90.48, 90.49, 90.5, 123/90.52, 90.55, 90.56, 90.67; 74/569

[56] References Cited

U.S. PATENT DOCUMENTS

| | | | |
|---|---|---|---|
| 3,967,602 | 7/1976 | Brown | 123/90.56 |
| 4,696,265 | 9/1987 | Nohira | 123/90.55 |
| 4,745,888 | 5/1988 | Kapp | 123/90.55 |
| 4,773,358 | 9/1988 | Heath | 123/90.67 |
| 4,825,823 | 5/1989 | Schaeffler | 123/90.55 |

FOREIGN PATENT DOCUMENTS

| | | | |
|---|---|---|---|
| 0225096 | 6/1987 | European Pat. Off. | 123/90.55 |
| 2948882 | 6/1981 | Fed. Rep. of Germany | 123/90.55 |
| 3004396 | 8/1981 | Fed. Rep. of Germany . | |

*Primary Examiner*—Charles J. Myhre
*Assistant Examiner*—Weilun Lo
*Attorney, Agent, or Firm*—Brumbaugh, Graves, Donohue & Raymond

[57] ABSTRACT

In the embodiments disclosed in the specification, a valve mechanism, preferably for an internal combustion engine, includes a valve spring guide sleeve which receives a cup plunger and has a supply passage for a hydraulic pressure medium in one wall. The guide sleeve at least partially encloses the valve spring and the supply passage is disposed unilaterally in the guide sleeve which has a smaller wall thickness on the side away from the supply passage.

5 Claims, 1 Drawing Sheet

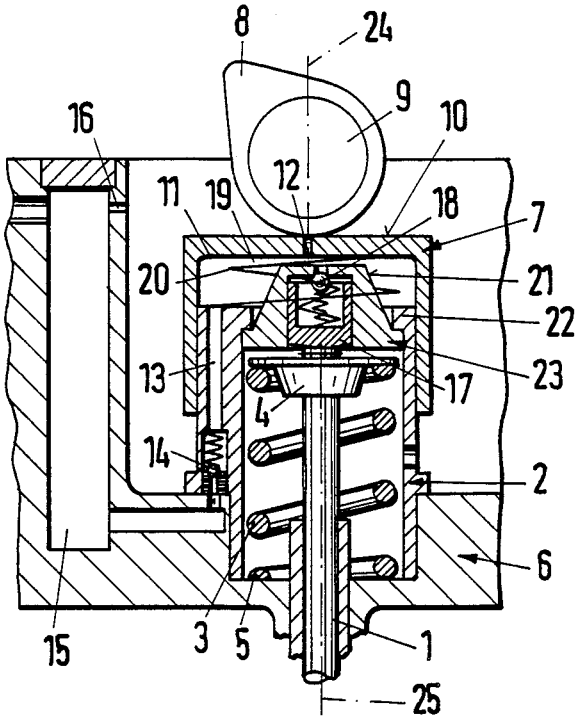
8
24
9
10
16
12
11
19
18
7
20
21
22
13
23
17
4
14
2
6
15
3
5
1
25

VALVE MECHANISM, PREFERABLY FOR AN INTERNAL COMBUSTION ENGINE, HAVING PRESSURE MEDIUM SUPPLY PASSAGE

BACKGROUND OF THE INVENTION

This invention relates to valve mechanisms preferably for internal combustion engines and, more particularly, to such valve mechanisms having pressure medium supply passages.

Heretofore, certain valve mechanisms for internal combustion engines, particularly for the intake valve, have included a cup-shaped plunger providing a contact surface for a valve control cam and a device for controlling the distance between the contact surface and the free end of the valve stem. Among devices affecting the distance between the cup plunger contact surface and the free end of the valve stem, for example, are hydraulic devices for varying the opening time of the valve as a function of the engine speed or of the load at a given time, or for compensating valve play, or damping devices that prevent hard impact of the valve member upon its seat during closing of the valve.

One valve mechanism of this type is disclosed by German Offenlegungsschrift No. 3004396 wherein the free end portion of a valve stem protrudes into the end of a guide sleeve facing the valve which sleeve contains a piston of a device for controlling the distance between the valve stem and the cam. In that arrangement, the closing spring of the valve extends outside the guide sleeve between a spring disk on the valve stem and a shoulder in a recess of a cylinder head containing the valve with the cup-shaped plunger an the guide sleeve. The closing spring has a larger diameter than the guide sleeve thus requiring a relatively long structure for the valve and valve mechanism.

In addition, a supply passage for a pressure medium such as oil is incorporated in the guide sleeve in the form of an annular passage so that the wall thickness of the guide sleeve is constant around its entire periphery. The guide sleeve at its end near the camshaft is enclosed by the cup plunger at the camshaft end, forms a housing with a connecting nozzle accommodating a hydraulic device to compensate for play and a throttling device for hydraulic control of the valve actuation times as a function of the engine load.

The prior art also describes hydraulic devices for controlling valve times as a function of rotational speed. In U.S. Pat. No. 3,967,602, such a device includes an orifice in the face of the cup plunger forming the contact surface for the cam and the flow of oil through the orifice is greater at low speeds than at high speeds, causing the opening time of the valve to be less at low speeds than at higher ones.

SUMMARY OF THE INVENTION

Accordingly, it is an object of the present invention to provide a new and improved valve mechanism which overcomes the above-mentioned disadvantages of the prior art.

Another object of the invention is to provide a valve mechanism having a variable distance between the valve stem and the cam-engaging surface which has smaller dimensions than the prior art devices, especially in the axial direction of the valve stem.

These and other objects of the invention are attained by providing a valve mechanism wherein a supply passage for a pressure medium is unilaterally incorporated in the guide sleeve for a cup plunger and the wall of the guide sleeve is thicker on the side containing the passage than on the other side. In addition, the valve-closing spring is disposed at least partially within the guide sleeve.

Thus, the invention does not consist merely of positioning the valve-closing spring partly inside the guide sleeve. Instead, the invention also takes into account the fact that valve-closing springs having a plurality of concentric spring members may be used by providing a guide sleeve having sufficient internal diameter to accommodate them. Such valve springs may present difficulties when the guide sleeve is arranged in accordance with the above-mentioned German offenlegungsschrift if each cylinder has several valves closely adjacent to each other, since sufficient wall thickness must be provided in the cylinder head between the adjacent valve mechanisms.

For this reason, the invention provides that a supply passage for the hydraulic pressure medium, leading, for example, to a device for compensating valve play or for controlling valve opening times in relation to a parameter, is incorporated only in one side of the guide sleeve, and that the wall thickness of the opposite side of the guide sleeve and, if desired, in wall areas adjacent to the supply passage, is reduced to a value determined by the required mechanical strength of the guide sleeve. If the guide sleeves of adjacent valves are then arranged so that their supply passages lie in the wall regions away from the guide sleeve of the adjacent valve mechanism, two adjacent valve mechanisms can be accommodated relatively close together, without requiring the inside diameters of the guide sleeves to be so small as to cause difficulties in accommodating the valve closing springs.

In addition, it is possible to incorporate a check valve associated with the hydraulic medium supply passage in line with the passage in the wall of the guide sleeve. This is especially advantageous because the sealed connections between the supply passage and parts preceding it in the hydraulic medium supply system, for example, the cylinder head, are outside the region of relatively high hydraulic pressure. On the other hand, a gas or vapor bubble separator for the hydraulic medium can be arranged outside of the guide sleeve, because the degassing, or removal of vapor bubbles from the liquid hydraulic medium, may be accomplished in the low pressure portion of the system.

BRIEF DESCRIPTION OF THE DRAWING

Further objects and advantages of the invention will be apparent from a reading of the following description in conjunction with the accompanying drawing, which is an axial sectional view of a representative embodiment of the invention showing the valve mechanism and the surrounding portion of the cylinder head of the engine.

DESCRIPTION OF PREFERRED EMBODIMENTS

In the typical embodiment shown in the drawing, a valve stem 1 of a combustion chamber valve, which has a conventional construction and therefore is not illustrated in detail, has a free end portion extending into a guide sleeve 2 which accommodates a valve closing spring 3. The spring 3 bears at one end against a valve disk 4 affixed to the valve stem 1 and at the other end on a shoulder 5 formed in the cylinder head 6 of the internal combustion engine. The head 6 is formed with a recess to receive the end of the guide sleeve 2 and also has a relatively large recess above it, as seen in the drawing, to accommodate other parts of the valve mechanism. These parts include a cup-shaped plunger 7 enclosing the upper portion of the guide sleeve 2, as seen in the figure, and axially displaceable thereon under the action of a cam 8 mounted on a camshaft 9 which is driven in the usual manner by the engine. The cup plunger 7 thus has a cam-engaging surface 10 contacted by the cam 8 having a wall 11 formed with a leak orifice 12. This arrangement provides for regulation of the valve opening time as a function of rotational speed of the engine in the manner described in the aforementioned U.S. Pat. No. 3,967,602.

The guide sleeve 2 is formed at one side with a supply passage 13 for a hydraulic pressure medium to supply pressure medium to the space enclosed by the guide sleeve 2 and the plunger 7, as described hereinafter. In line with the supply passage 13 in the left wall portion of the guide sleeve 2, as seen in the drawing, there is a check valve 14, the inlet side of which, pointing downward in the figure, communicates with a system of pressure medium conduits 15 in the body of the cylinder head 6. This system acts by way of an orifice 16 in the wall of the recess containing the valve mechanism as a vapor and gas separator. The orifice 16 is oriented so that pressure medium emerging from it will provide lubrication between the contact surface 10 and the cam 8.

Because the supply passage 13 is formed on only one side of the guide sleeve 2, it is possible, in accordance with the invention, to make the wall thickness on the other side of the guide sleeve, i.e., on the right as seen in the figure, considerably smaller than the wall of the left-hand portion of the sleeve containing the supply passage 13. Hence it is possible to accommodate another valve in the cylinder head 6 on the right side as viewed in the figure very close to the illustrated stem 1. The adjacent valve may have the same construction as the illustrated mechanism, preferably with the supply passage corresponding to the supply passage 13 located on the right side, as viewed in the drawing, of the adjacent guide sleeve.

Within the space enclosed by the guide sleeve 2 and the cup plunger 7, there is a compensating piston 17 and a check valve 18 along with an arrangement for regulating the valve stroke, and hence the opening time of the valve, as a function of rotational speed. This arrangement includes the aforementioned leak orifice 12, a pressure chamber 19 and a spring 20 arranged therein to aspirate hydraulic medium. This arrangement operates in the manner described in the previously mentioned U.S. patent so that, with suitable dimensioning of the orifice 12, pressure medium ejected through the orifice 12 will cause a decrease of the distance between the plunger 7 ad the valve stem 1 and hence an early closing of the valve. This occurs essentially at low speeds, whereas at high speeds, because there is considerably less flow of pressure medium through the orifice 12, such relative axial motion of the plunger 7 will be substantially less.

Moreover, the valve mechanism includes a damping arrangement with a piston 23 having a conical surface 21 which cooperates with a step contour 22 in the guide sleeve 2. In the accompanying drawing, the parts of the valve mechanism are illustrated in their positions when the valve is closed. In this condition, the collar of the piston 23 engages the step contour 22 as a result of the action of the compensating piston 17. When the valve is open, the damping piston 23 is lifted off the step contour 22. During the last phase of the closing action of the valve, the conical surface 21 forms an annular throttling passage together with the step contour 22. During the last phase of the closing, the flow cross-section decreases at an increasing rate with upward motion of the damping cylinder 23, as viewed in the figure, thereby damping the closing action of the valve in its final phase.

In addition, it should be noted that the centerlines 24 and 25 of the plunger 7 and the valve stem 1 are offset from each other by the difference between the wall thicknesses of the guide sleeve 2 in the portions on the left and right of the figure. In the embodiment shown by way of example, the guide sleeve 2 is constructed so that its inner wall facing the closing spring 3 is cylindrical. As a result, the outside wall of the guide sleeve is of noncircular cross-section in the region of the supply passage 13 and the collar of the plunger 7 must conform to that shape. In this way, a rotational restraint is provided for the plunger 7. Alternatively, it will be understood that the outer and inner surfaces of the guide sleeve may be eccentric cylinders.

The invention thus provides a speed-responsive valve mechanism which, by virtue of at least partial accommodation of the valve closing spring in the guide sleeve, is of axially short construction and, despite a possible enlargement of its transverse dimension, permits close positioning of an adjacent valve mechanism.

Although the invention has been described herein with reference to specific embodiments, many modifications and variations therein will readily occur to those skilled in the art. Accordingly, all such variations and modifications are included within the intended scope of the invention.

I claim:

1. A valve mechanism preferably for an internal combustion engine, comprising a valve having a stem, a valve spring surrounding the valve stem, a stationary guide sleeve at least partially enclosing the valve spring, a cup plunger axially displaceable on the stationary guide sleeve and having a contact surface for a valve drive cam, and a pressure medium supply passage unilaterally incorporated in the wall of the guide sleeve to supply pressure medium for controlling the distance between the plunger contact surface and the free end of the valve stem, the wall thickness of the guide sleeve being smaller on the side away from the supply passage than in the region containing that passage.

2. A valve mechanism according to claim 1 including a check valve associated with the pressure medium supply passage incorporated in the wall of the guide sleeve and aligned with the supply passage.

3. A valve mechanism according to claim 1 wherein the valve spring is completely within the guide sleeve and one end of the valve spring engages an abutment thereof or of a component in which the guide sleeve is mounted.

4. A valve mechanism according to claim 1 including a bubble separator arranged in flow communication with the supply passage within a component in which the guide sleeve is mounted.

5. A valve mechanism according to claim 1 wherein the centerline of the valve stem is offset from the centerline of the cup plunger by an amount corresponding to the difference between the supply passage wall thickness of the guide sleeve and the opposite wall thickness of the guide sleeve.

* * * * *